United States Patent [19]

Etoh et al.

[11] 4,303,053

[45] Dec. 1, 1981

[54] SPLIT MODE INTERNAL COMBUSTION ENGINE WITH IMPROVED $NO_x$ reduction means

[75] Inventors: Yukihiro Etoh, Yokohama; Toshiaki Tanaka, Fujisawa; Haruo Yonezawa, Yokohama; Yoshikatsu Sakamoto, Yokosuka, all of Japan

[73] Assignee: Nissan Motor Company, Limited, Yokohama, Japan

[21] Appl. No.: 146,019

[22] Filed: May 2, 1980

[30] Foreign Application Priority Data

May 7, 1979 [JP] Japan ..... 54-55395

[51] Int. Cl.[3] ..... F02M 25/06; F02D 17/00; F01N 3/15

[52] U.S. Cl. ..... 123/568; 123/198 F

[58] Field of Search ..... 123/568, 569, 571, 198 F

[56] References Cited

U.S. PATENT DOCUMENTS

| | | | |
|---|---|---|---|
| 4,106,471 | 8/1978 | Nakajima et al. | 123/198 F |
| 4,201,180 | 5/1980 | Iizuka | 123/198 F |
| 4,231,338 | 11/1980 | Sugasawa et al. | 123/568 |
| 4,249,374 | 2/1981 | Sugasawa et al. | 123/568 |
| 4,250,850 | 2/1981 | Ruyer | 123/198 F |

*Primary Examiner*—Wendell E. Burns

*Attorney, Agent, or Firm*—Schwartz, Jeffery, Schwaab, Mack, Blumenthal & Koch

[57] ABSTRACT

Under light load condition wherein only selected cylinders are fired or operate, low temperature exhaust gas gathering in an exhaust chamber for the unused cylinders is introduced into an intake chamber for the firing cylinders thereby to allow the firing cylinders to produce a less amount of $NO_x$.

4 Claims, 2 Drawing Figures

SPLIT MODE INTERNAL COMBUSTION ENGINE WITH IMPROVED $NO_x$ reduction means

FIELD OF THE INVENTION

The present invention relates to a multi-cylinder internal combustion engine, and more particularly to a so-called "split mode engine" having cylinders some of which are prevented from being fed with fuel under light load condition of the engine for fuel economy.

BACKGROUND OF THE INVENTION

It is known in the art that internal combustion engines nowadays used have a tendency to show high fuel efficiency when each cylinder operates under high load condition. Thus, for improvement in overall fuel consumption of the engine, a technique has been put into practice wherein under light load condition of the engine, some of the cylinders are stopped from being fed with fuel for applying higher operation loads to the other firing cylinders. One of the engines using the above technique is constructed such that when the engine runs on only selected cylinders under light load condition, the engine exhaust gas having generally the same pressure as the atmospheric air is introduced into the unused (or unfired) cylinders to minimize the pumping loss caused by the pumping movement of the unused cylinders. This engine shows a better result in fuel consumption.

However, these engines mentioned above cause inevitably increase of $NO_x$ contained in the exhaust gas because of application of higher operation loads to the firing cylinders.

It should be noted that, hereinafter, the term "all cylinders working condition" refers to a condition wherein all cylinders of the engine are fired to generate output power, while the term "selected cylinders working condition" refers to a condition wherein only selected cylinders are fired to generate the output power.

OBJECTS OF THE INVENTION

It is therefore an object of the present invention to provide an improved split mode internal combustion engine which is free of the above-mentioned drawback.

It is another object of the present invention to provide an improved split mode internal combustion engine which uses as a $NO_x$ reduction medium to be fed to the firing cylinders a low temperature exhaust gas which is provided by the unused cylinders under light load condition of the engine.

It is still another object of the present invention to provide a split mode internal combustion engine which is simple in construction.

Other objects and advantages of the present invention will become clear from the following description when taken in conjunction with the accompanying drawings.

DESCRIPTION OF THE EMBODIMENTS

Figure 1:
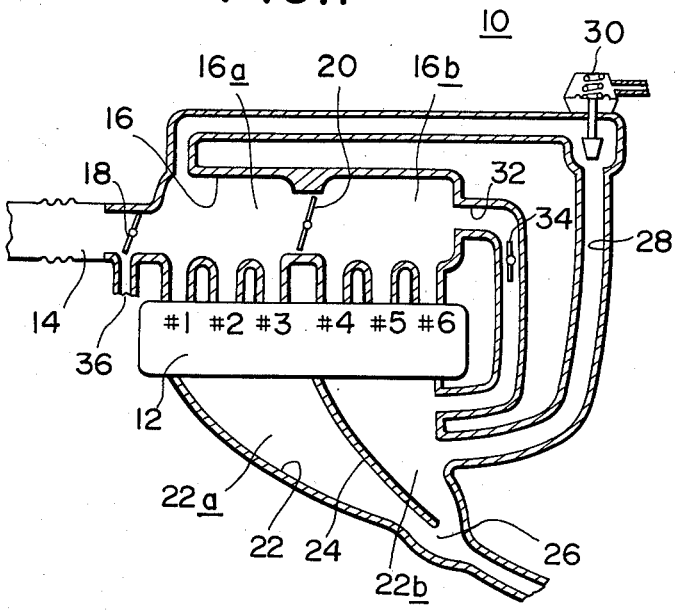
FIG. 1 is a schematic view of a split mode internal combustion engine as a first preferred embodiment of the present invention.

Referring to FIG. 1, there is shown the first embodiment of the invention. The engine 10 of this embodiment generally comprises an engine proper 12, an intake system (no numeral), an exhaust system (no numeral) and an exhaust gas recirculation system (no numeral). The engine proper 12 shown is of a multi-cylinder type having six cylinders #1 to #6. The intake system comprises an intake tube 14, an intake manifold 16 with six tubes (no numerals) respectively connected to the six cylinders #1 to #6 of the engine proper 12, a first throttle valve 18 arranged at an upstream section of the intake manifold 16 and a second throttle valve 20 arranged at a generally middle section of the manifold 16. Although not shown, the first throttle valve 18 is connected via suitable linkage means with an acceleration pedal in such a manner that depression of the pedal causes the first throttle valve 18 to open. As shown, the second throttle valve 20 is arranged to be capable of dividing the intake manifold 16 into two sections **16*a* and 16*b*, the section 16*a* being communicated with the cylinders #1 to #3 while the section 16*b* being communicated with the cylinders #4 to #6. The cylinders #1 to #3 are designed to operate or be fed with fuel normally irrespectively of variations of the operation loads applied to the engine, while the cylinders #4 to #6 are designed to be fed with fuel only when the engine 10 operates under high load condition. For this purpose, a fuel injector or the like (not shown) is installed in each of the tubes of the intake manifold 16. As is disclosed in U.S. Pat. No. 4,143,635 to Haruhiko Iizuka et al, the fuel injector is designed to feed fuel to the corresponding cylinder only when firing of the cylinder is actually required for generation of output power. Thus, under high load condition of the engine 10, all fuel injectors operate, but under light load condition only three fuel injectors corresponding the cylinders #1 to #3 operate. (Instead of using the above-mentioned type fuel injectors, a carburetor arranged upstream of the first throttle valve 20** may be used as is disclosed in U.S. Patent Application Ser. No. 965,994.)

The second throttle valve 20 is designed to close thereby stopping air supply to the cylinders #4 to #6 only when the engine 10 is subjected to light load operation, so that under such light load operation, only three cylinders #1 to #3 are fired for generation of output power of the engine 10. The exhaust system comprises an exhaust chamber 22 and a partition wall 24. The partition wall 24 is arranged in the exhaust chamber 22 in a manner to divide the same into two sections **22*a* and 22*b* which are communicated respectively with the cylinders #1 to #3 and the cylinders #4 to #6. As shown, the two sections 22*a* and 22*b* are united at a downstream portion 26 of the exhaust chamber 22. The exhaust gas recirculation system comprises first exhaust gas recirculating means (no numeral) which can provide a communication between the section 22*b* of the exhaust chamber 22 and the section 16*a* of the intake manifold 16, and second exhaust gas recirculation means (no numeral) which can provide a communication between the section 22*b* and the section 16*b* of the intake manifold 16. The first exhaust gas recirculation means includes a passage 28 connecting the section 22*b* with the section 16*a*, and a flow controller 30 arranged in a suitable portion of the passage 28. The flow controller 30 which is shown as a vacuum actuated valve is so designed to vary the flow rate of the recirculating exhaust gas in the passage 28 in proportion to the flow rate of fresh air passing through the intake tube 14. The flow controller 30 may be so constructed that the most suitable amount of exhaust gas for reduction of $NO_x$ is introduced into the intake manifold 16 when all of the cylinders #1 to #6 are fired under high load condition of the engine. The second exhaust gas recirculation means comprises a passage 32 connecting the section 22***b* with the section 16*b*, and a third throttle valve 34 arranged in a suitable portion of the passage 32. The third throttle valve 34 is designed to take only full-open and full-closed positions and arranged such that under light load condition of the engine 10, the third throttle valve 34 fully opens thereby feeding the exhaust gas gathering in the section 22*b* into the section 16*b*, but under high load condition of the engine 10, the valve 34 fully closes thereby stopping the feeding of the exhaust gas into the section 16*b*. Designated by numeral 36 is a port which is fluidly connected to actuators (not shown) of the second and third throttle valves 20 and 34 for driving these valves in accordance with the magnitude of vacuum created in the vicinity of the first throttle valve 18.

When the engine 10 operates under high load condition, the engine 10 takes the "all cylinders working condition" with the second throttle valve 20 open and the third throttle valve 34 closed. Thus, desired volume of exhaust gas is introduced via the first exhaust gas recirculation means (28 and 30) into the entire space of the intake manifold 16 in accordance with the flow rate of the intake air passing through the intake tube 14. Under this condition, it is known that the temperature in each cylinder on fire is kept relatively low thereby causing the engine 10 to produce a less amount of $NO_x$.

Under this condition, when the engine 10 is subjected to light load condition, the engine 10 takes the "selected cylinders working condition" with the second throttle valve 20 closed and the third throttle valve 34 open. Thus, in this condition, the fresh air supply to the cylinders #4 to #6 stops and simultaneously fuel supply to these cylinders also stops, and the exhaust gas gathering in the section 22*b* is cyclically fed via the second exhaust gas recirculation means (32 and 34) into the section 16*b*. Thus, the temperature of the exhaust gas thus recirculated is gradually lowered during idle pumping operation of these unused cylinders #4 to #6, with a result that the temperature of the exhaust gas in the section 22*b* is sufficiently lowered irrespective of a fact that, under this condition, a part of the exhaust gas emitted from the firing cylinders #1 to #3 enters the section 22*b* through the open portion 26. The low temperature exhaust gas thus gathering in the section 22*b* is introduced via the first exhaust gas recirculation means (28 and 30) into the section 16*a*. It will be appreciated that the feeding of the low temperature exhaust gas into the section 16*a* considerably lowers the combustion temperature in each of the firing cylinders #1 to #3 thereby suppressing formation of $NO_x$ in the exhaust gas from these firing cylinders.

In the engine 10, the flow rate of the intake air actually fed to engine proper 12 scarcely changes even when the operation condition of the engine 10 changes from the "all cylinders working condition" to the "selected cylinders working condition" and vice versa. However, upon this change, the operation load applied to each of the firing cylinders #1 to #3 is inevitably increased. Although, increase in operation load applied to each firing cylinder commonly means increase of $NO_x$ contained in the exhaust gas emitted from the engine 10, the feeding of low temperature exhaust gas to the firing cylinders #1 to #3 causes these cylinders to produce a less amount of $NO_x$. In fact, the reduction of $NO_x$ in the exhaust gas may be achieved by increasing the flow rate of the exhaust gas fed to the firing cylinders #1 to #3. However, in the engine 10, the increase of the flow rate of the recirculating exhaust gas is not expected because, as has been mentioned above, the flow rate of the exhaust gas fed to the cylinders scarcely changes between the "all cylinders working condition" and the "selected cylinders working condition".

Figure 2:
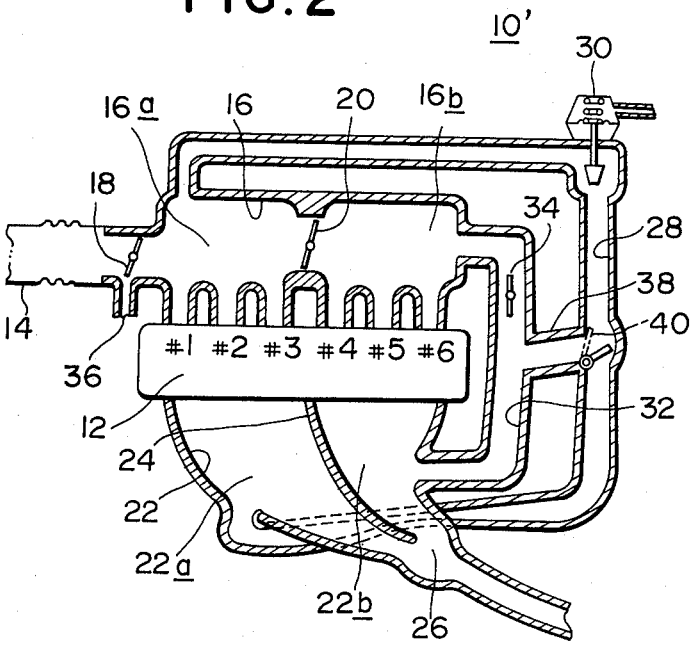
FIG. 2 is a view similar to FIG. 1, but shows a second preferred embodiment of the present invention.

Referring to FIG. 2, there is shown the second embodiment of the invention. In the following, explanation of substantially the same parts or constructions as in the case of the first embodiment will be omitted for ease of description. The same parts or constructions are designated by the same numerals as in FIG. 1.

As will be understood from the drawings, one constructional difference of the engine 10' of this second embodiment from that of the first embodiment is that a bypass means is arranged between the first and second exhaust gas recirculation means. The bypass means comprises a passage 38 which connects the passages 28 and 32 at sections upstream of the flow controller 30 and the third throttle valve 34. Mounted to a portion where the passages 28 and 32 are united is a two-way valve 40. The valve 40 is designed such that when the engine 10' is in the "all cylinders working condition", the valve takes a first portion (shown by broken lines) establishing a communication between the upstream section of the passage 28 and the downstream section of the same, further when the engine 10' is in the "selected cylinders working condition", the valve 40 takes a second position (shown by real lines) establishing a communication between the downstream section of the passage 28 and the passage 38. Another constructional difference is that the entrance of the passage 28 is open to the section 22*a*, as shown.

When the engine 10' operates under high load condition with all cylinders #1 to #6 being fired, the second throttle valve 20 opens, the third throttle valve 34 closes and the two-way valve 40 takes the first position (shown by broken lines). Thus, under this condition, the exhaust gas gathering in the section 22*a* is fed via the flow controller 30 into the entire space of the intake manifold 16. As has been mentioned hereinbefore, the volume of the recirculated exhaust gas running in the passage 28 is suitably controlled by the flow controller 30 in accordance with the flow rate of the intake air passing through the intake tube 14, for effective reduction of $NO_x$ contained in the exhaust gas emitted from each firing cylinder.

Under this condition, when the engine 10' is subjected to light load operation, the engine 10' takes the "selected cylinders working condition" with the second throttle valve 20 closed, the third throttle valve 34 open and the two-way valve 40 taking the second position (shown by real lines). Thus, in this condition, the temperature of the exhaust gas thus cyclically fed to the unused cylinders #4 to #6 is gradually lowered, so that the temperature of the exhaust gas gathering in the section 22*b* is sufficiently lowered. The low temperature exhaust gas is thus fed to the firing cylinders #1 to #3 for effective reduction of $NO_x$ in the exhaust gas emitted from these cylinders.

With the above, it will be appreciated that according to the present invention, the reduction of $NO_x$ contained in the exhaust gas emitted from the firing cylinders is achieved by feeding the low temperature exhaust gas provided by the unused cylinders into the firing cylinders.

What is claimed is:

1. A split mode internal combustion engine comprising:

a first group of cylinders;

a second group of cylinders;

an intake system including first and second intake chambers which are respectively connected to said first and second groups cylinders for providing said cylinders with air-fuel mixture, and a valve means for providing a communication between said first and second intake chambers when said engine is in high load condition, and breaking said communication when said engine is in light load condition;

an exhaust system having first and second exhaust chambers which are respectively connected to said first and second groups of cylinders for separately receiving therein the exhaust gas emitted from said cylinders, said first and second exhaust chambers being united at their downstream portions;

means for controlling said first and second groups of cylinders in such a manner that when said engine is in the high load condition, all of said first and second groups of cylinders operate to produce power, but when said engine is in the light load condition, only said first group of cylinders operate to produce power;

first exhaust gas recirculation means for feeding the exhaust gas contained in either one of said first and second exhaust chambers into said first intake chamber when said engine is in the high load condition, and feeding the exhaust gas gathering in said second exhaust chamber into said first intake chamber when said engine is in the light load condition; and second exhaust gas recirculation means for feeding the exhaust gas gathering in the said second exhaust chamber into said second intake chamber only when said engine is in the light load condition.

2. A split mode internal combustion engine as claimed in claim 1, in which said second exhaust gas recirculation means comprises:

a second passage connecting said second exhaust chamber with said first intake chamber; and a valve installed in said second passage, said valve closing said second passage when the engine is in the high load condition and opening said second passage when the engine is in the light load condition.

3. A split mode internal combustion engine as claimed in claim 2, in which said first exhaust gas recirculation means comprises:

a first passage connecting said second exhaust chamber with said first intake chamber; and a flow controller for controlling the flow rate of the exhaust gas passing through said first passage in proportion to the flow rate of fresh air consumed by said cylinders.

4. A split mode internal combustion engine as claimed in claim 2, in which said first exhaust gas recirculation means comprises:

a first passage connecting said first exhaust chamber with said first intake chamber;

a bypass passage having one end open to said second passage at a section upstream of said valve and the other end open to a portion of said first passage;

a two-way valve installed at said portion of said first passage, said two-way valve closing only said bypass passage when said engine is in the high load condition and closing only said first passage when said engine is in the light load condition; and a flow controller disposed on said first passage at a section downstream of said portion of said first passage, said flow controller controlling the flow rate of the exhaust gas to be fed into said first intake chamber in proportion to the flow rate of fresh air consumed by said cylinders.

* * * * *